United States Patent [19]

Fort et al.

[11] 4,180,300

[45] Dec. 25, 1979

[54] DOUBLE RING AND RADIAL CONDUCTOR ASSEMBLY FOR LARGE HOLLOW SHAFTS

[75] Inventors: Emil M. Fort, Murrysville, Pa.; Jacques E. Albaric, Nimes, France

[73] Assignee: Westinghouse Electric Corp., Pittsburgh, Pa.

[21] Appl. No.: 857,480

[22] Filed: Dec. 5, 1977

[51] Int. Cl.[2] ..... H01R 39/00

[52] U.S. Cl. ..... 339/5 R

[58] Field of Search ..... 339/5 R, 5 S, 5 RL

[56] References Cited

U.S. PATENT DOCUMENTS

| | | | |
|---|---|---|---|
| 3,059,202 | 10/1962 | Huber | 339/5 R |
| 3,102,765 | 9/1963 | Newman | 339/5 RL |

*Primary Examiner*—Roy Lake
*Assistant Examiner*—DeWalden W. Jones
*Attorney, Agent, or Firm*—J. W. Keen

[57] ABSTRACT

A double ring and radial lead assembly for electrically connecting the exterior and interior of a large, hollow shaft. A first ring secured to the shaft has a radial opening therethrough in general alignment with a radial opening in the shaft between its exterior surface and its interior surface. The first ring is secured to the shaft through an interference fit. An electrical conductor is arranged in the generally aligned openings and is secured in such position. A second conductive ring is attached to the first ring through an interference fit and covers the radially outer end of the radial lead. The second ring acts as a slip ring and provides a rotatable electrical contact surface for maintaining electrical connection with a stationary electrical source. The radially directed conductor and both rings are electrically insulated from the shaft.

6 Claims, 3 Drawing Figures

DOUBLE RING AND RADIAL CONDUCTOR ASSEMBLY FOR LARGE HOLLOW SHAFTS

BACKGROUND OF THE INVENTION

1. Field of the Invention

This invention relates to rotatable shafts and more particularly to means for electrically connecting a stationary electrical source to the interior region of a hollow shaft.

2. Description of the Prior Art

Large steam turbines used in central power station applications must be periodically shut down for maintenance and other reasons such as refueling a nuclear power reactor. Shaft rotation of large turbines is continued after shutdown at low speeds by utilizing turning gears. When it is desired to bring the turbine up to synchronous speed and load, the metal in the turbine's stationary and rotatable parts must be increased in temperature at a relatively slow rate to avoid formation of high internal stresses which can result in mechanical failure. To avoid such overstressing and possibility of mechanical failure, the metal temperature of large steam turbines is raised slowly by gradually increasing both the steam temperature and mass flow rate therethrough. Such gradual increases result in inordinately long elapsed times between turbine shutdown or turning gear operation and full load, synchronous speed operation.

Such long elapsed times are very expensive and reduce the turbine's availability to meet rapidly increasing load demands.

To compensate for such slow starting capability additional, partially loaded turbines may be continuously operated so as to obviate the need for fast startups of shut-down turbines. However, additional power generation equipment is expensive and may have to be operated at offdesign, lower efficiency conditions to satisfactorily respond to load demand variations. Thus, additional generating capacity could result in not only higher capital costs, but also presents the possibility of higher operating costs. It would also be desirable to have a fast starting steam turbine which did not require maintaining a heating fluid at a temperature level above the turbine metal transition temperature. Shaft metal near the shaft's bore is the highest stressed and the thermally slowest responding turbine portion to steam heating on the shaft's exterior.

A possible solution to the aforementioned problems is the use of electric bore heaters inserted in the hollow turbine shaft's interior. Such placement of electrical heaters requires an electrical conducting arrangement which transfers electricity from an exterior source to the shaft's interior while insulating the shaft from such electrical conduction. Devices used in prior applications for receiving electricity from a stationary source and transferring it to a rotating member include slip rings which were formerly utilized on generators before the advent of brushless exciters. Such slip rings were seldom larger than 14 or 15 inches in diameter because they were not required for generators of relatively low ratings and the contrifugal force acting on rings larger than that was excessive and frequently resulted in ring failure. Additionally, the contacting brushes for the slip rings had relatively short lives for larger diameter slip rings since surface speeds of such larger slip rings increased as the slip ring diameter increased.

It has been found to be highly desirable to mount the slip rings on the shaft's driving flange between the steam turbine and the generator since such arrangement provides easy access to the contacting brushes and obviates the need for a longer turbine and turbine rotor. The driving flanges on a turbine rotor are frequently 30 inches in diameter and more. Use of radial leads to transfer electrical energy from the shaft's outer periphery to its interior bore is suggested, but introduces the further problems of connecting it with the peripherally disposed slip ring. A mechanical connection between the slip ring and radial conductor often requires some kind of opening to be formed radially through the slip ring to provide later insertion of the radial conductor therein. Such opening formation in the already highly stressed slip ring further reduces the slip ring's strength and augments stress concentration effects. Metallurgical joints formed by processes such as brazing between the slip ring and the radial conductor have disadvantages in that localized high temperatures inherent in such processes may damage the insulation between such conducting arrangement and the shaft.

The aforementioned problems could be alleviated by apparatus which permits rapid steam turbine startup from turn gear operation to full load and, at the same time, increases the reliability of the turbine over presently acceptable designs.

SUMMARY OF THE INVENTION

In accordance with the present invention, a rotatable electrical conductor arrangement is provided for receiving electrical energy from a stationary source disposed about the outer periphery of a hollow shaft and transferring that energy from such outer periphery to the interior space of such shaft in an insulated manner from such shaft. The invention generally comprises a hollow, rotatable shaft having an exterior and an interior surface, a first conductive mounting ring disposed on the shaft's exterior surface by means of an interference fit, an electrical conductor extending radially through the first ring into the shaft's interior, means for electrically connecting the radial conductor and first ring, and a second conductive ring attached to the outer periphery of the first ring with the attachment being the result of an interference fit between the first and second conductive rings. Electrical contact between the second conductive ring and one or more stationary electrical brushes provides electricity to the interior of the shaft for suitable use therein. The radially interior end of the electrical conductor is preferably attached to a terminal support which provides a connecting junction for any interiorly disposed electrical utilizing apparatus. Such slip ring arrangement is preferably disposed on an enlarged, flange portion of the shaft.

Such double ring construction allows the radial conductor to be inserted through the first ring while the second ring which is disposed about the first ring provides structural support therefor and diminishes the chance for first ring failure due to stress concentrations about the radial conductors's opening therethrough. Rapid brush wear for large diameter slip rings is not a significant design consideration when the brushes and slip rings are in contact for relatively short periods of time.

BRIEF DESCRIPTION OF THE DRAWINGS

The invention will be more fully understood from the following detailed description of a preferred embodiment, taken in connection with the accompanying drawings, in which.

DESCRIPTION OF THE PREFERRED EMBODIMENT

The present invention is concerned primarily with providing electrical energy supplied from a stationary source to the interior of a hollow, rotatable shaft such as is commonly utilized in a steam turbine. Accordingly, in the description which follows the invention is shown embodied in a large steam turbine, but it should be understood that the invention may be utilized as an electrical conducting apparatus in any machine having a hollow shaft portion.

Figure 1:
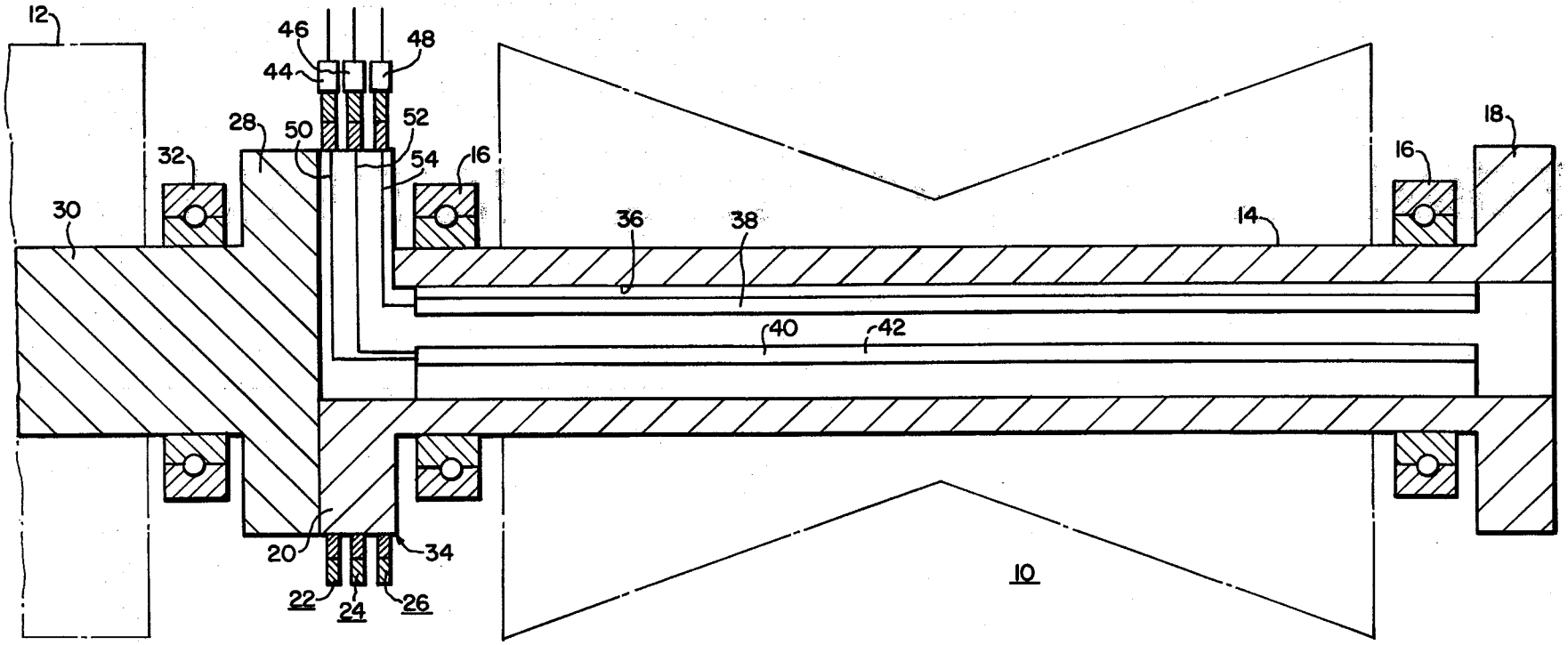
FIG. 1 is a partial transverse sectional view of an exemplary turbine in which the invention is incorporated.

FIG. 1 illustrates a partial transverse sectional view of a double flow steam turbine 10 which provides the driving force for a connected load such as generator 12. Hollow turbine shaft 14 is supported at either end by bearings 16 which may be journal, thrust, or any combination of the two types of bearings. Flange 18 on rotor 14 is illustrated at one axial end of turbine 10 and is shown to be unconnected although, it is to be understood that flange 18 may be attached to another load or another turbine section which contributes to the torque exerted on shaft 14 by turbine 10. Flange 20 located at the opposite axial end of turbine 10 has three sets of rings 22, 24, and 26 attached thereto in axially adjacent fashion. Turbine flange 20 is, in turn, connected to generator flange 28 which is part of generator rotor shaft 30. Rotor shaft 30 is supported on the illustrated generator end by bearings 32.

Turbine rotor flange 20 has an exterior surface 34 and an interior surface 36 which extends axially through a major portion of shaft 14. Turbine bore heaters 38, 40, and 42 are illustrated as being disposed within interior surface 36 but, it is to be understood that any other electrical utilizing apparatus may also be situated therein. Electrical brushes 44, 46, and 48 are illustrated in the contact position with rings sets 22, 24, and 26 respectively. When it is desired to remove the electrical brushes from contact with the ring sets, an electrical or hydraulic actuating device may selectively displace the brushes radially inward and outward relative to the ring sets. Three ring sets are illustrated in FIG. 1 for the purpose of utilizing three phase electrical power. Such three phase configuration is preferred for applications such as the illustrated bore heaters since it permits uniform heater distribution around shaft 14's axis of rotation. However, other applications may utilize the present invention in transferring single or multiphase electrical currents as may be advantageously required by the utilizing apparatus. Radial conductor leads 50, 52, and 54 extend from exterior surface 34 to interior surface 36. For convenience of illustration in FIG. 1 the radial leads have been rotated from their actual position, better illustrated in FIG. 3, to the same circumferential plane in FIG. 1.

Figure 2:
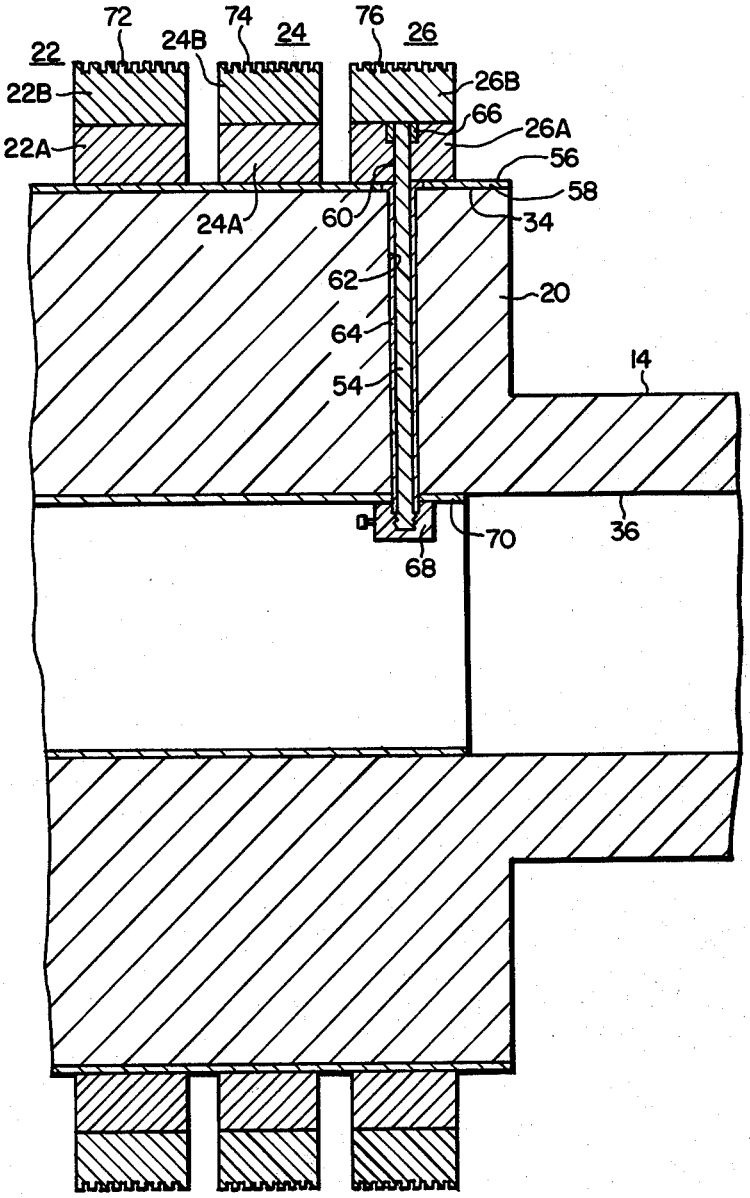
FIG. 2 is a transverse sectional view of a portion of the shaft illustrated in FIG. 1.

FIG. 2 illustrates an expanded cross-sectional view of turbine rotor flange 20 and the apparatus attached to and in the vicinity thereof. Ring sets 22, 24, and 26 respectively constitute mounting ring 22*a*, slip ring 22*b*, mounting ring 24*a*, slip ring 24*b*, mounting ring 26*a*, and slip ring 26*b*. Ring sets may ordinarily be disposed about a reduced diameter portion of a shaft when one end of the shaft is unflanged but regardless of that consideration, it has been found to be advantageous to mount the ring sets about the shaft flange 20 for various reasons including easy access to the electrical brushes, retention of a relatively shorter rotor shaft, and greater torsional strength in the flange than in the smaller diameter rotor portion. Such greater torsional strength is the result of lower stress concentration factors for radial openings formed in the flange rather than in the rotor shaft itself.

Mounting rings 22*a*, 24*a*, and 26*a* of nominal inside and outside diameters of 32 inches and 33.25 inches respectively are secured to peripheral surface 56 which is, by example, 32 inches in diameter through a diametral interference fit of 0.037 inches. Outer flange surface 34 is separated from peripheral surface 56 by an insulating material 58 of suitable thickness such as $Al_2O_3$ which is bonded to outer flange surface 34 by a plasma spray process or detonation gun cladder process. To prevent deterioration of the insulation 58's peripheral surface 56, a resilient coating such as epoxy (not shown) is applied thereto.

Since the three sets of rings are very similar, only one set (26*a* and 26*b*) will be referred to. A radial opening 60 of 0.25" diameter formed in mounting ring 26*a* is assembled in general alignment with radial opening 62 in flange 20. Insulating sheath 64 made from glass Micarta, reinforced glass silicon laminate, or other suitable insulating material placed within opening 62 prevents electrical conduction from conductor lead 54 to rotor flange 20. Conductor lead 54 is held in electrical union with mounting ring 26*a* by use of joining member 66 which may be, by example, a wedge, matching conic surfaces, pins, or any other suitable electrical connection. Radial conductor lead 54 is supported by and connected with terminal support 68 through threaded engagement therewith. Terminal support 68 and radial conductor lead 54 are preferably copper, although it is to be understood that any other suitable conductor may be used. Terminal support 68 is electrically separated from inner shaft surface 36 by a layer of insulating material 70 such as $Al_2O_3$ applied thereon.

Slip rings 22*b*, 24*b*, and 26*b* with nominal inside and outside diameters of 33.25 and 35.25 inches are respectively connected through interference fits of 0.072 inches with mounting rings 22*a*, 24*a*, and 26*a*. Contact surfaces 72, 74, and 76 of the slip rings have helical grooves formed therein so as to avoid hotspots on the contacting electrical brushes by interrupting the current passing therebetween at least once per revolution at any point on the electrical brushes. Each mounting ring and attached slip ring is, by example, 1.125" wide in the axial direction of the shaft.

Figure 3:
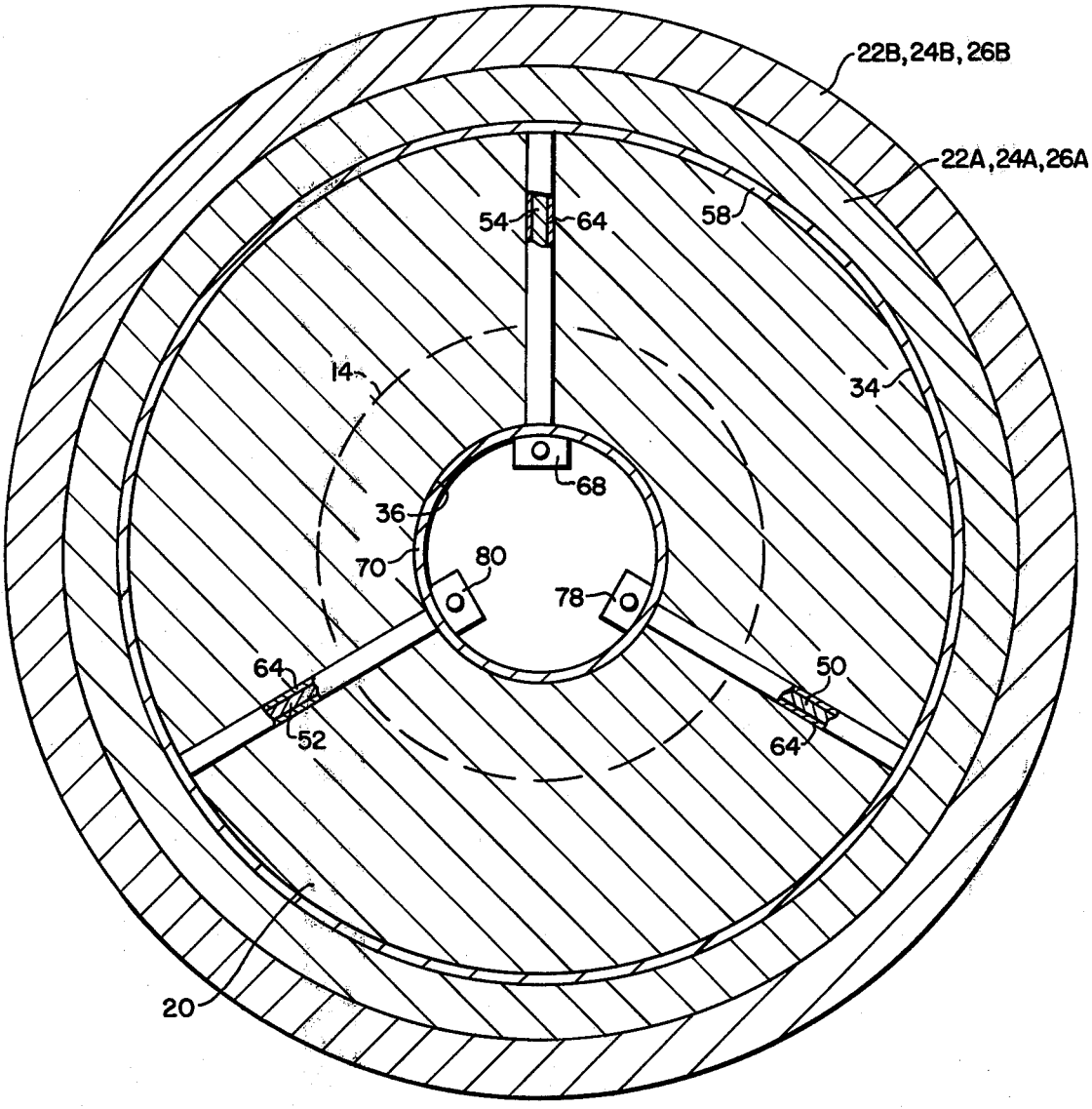
FIG. 3 is a sectional end view of the shaft illustrated in FIG. 2.

FIG. 3 is a partial axial sectional view of flange 20 illustrating the true relative configuration of the radial conductor leads 50, 52, and 54. It may be seen upon viewing FIG. 3 that the radial leads are distributed in a circumferentially uniform manner about the rotor shaft and are, in this case, separated by 120°. Due to such circumferential separation, FIG. 2 illustrates only lead 54 in a visually instructive position. The remaining leads numbered 50 and 52 are shown in FIG. 3 in respective engagement with terminal supports 78 and 80. Such circumferential distribution of radial leads was judged useful for a variety of reasons including reduction of stress concentration effect on mounting rings 22*a*, 24*a*, and 26*a*.

It will now be apparent that an improved conductor assembly constituting a slip ring and radial conductive lead combination has been provided in which two concentric circumferential interference fits are utilized to provide a rotatable conductor system capable of receiving electrical energy from a stationary source and transferring it radially through a shaft or other rotatable member to the interior thereof for use therein while effectively insulating the conductor assembly from the shaft. The mounting rings of the present invention provide a convenient, mechanical type electrical connection between the slip rings and the radial leads while the slip rings provide a contact surface for the brushes and strength of maintaining the structural integrity of the slip ring-mounting ring-radial lead assembly. Thus, large diameter slip ring arrangements may now be utilized without concern for their structural reliability.

We claim:

1. An elastic fluid turbine apparatus comprising:

a hollow, rotatable shaft having an exterior and an interior surface with a radial opening connecting them;

a first conductive ring insulatively secured to said shaft's exterior surface through an interference fit therewith, said ring having a radial opening therethrough;

an electrically conductive lead extending through said ring's opening and through the shaft's opening, said conductor lead being insulated from the shaft;

means for electrically connecting said electrically conductive lead and said first ring; and a second conductive ring attached to the outer periphery of said first ring, said attachment being through an interference fit, said second ring having an electrical contact surface for receiving electrical energy supplied thereto and for conducting it through said first ring and conductive lead to said shaft's interior.

2. The apparatus of claim 1, further comprising:

a terminal support disposed in the interior of said shaft for supporting the interior end of the electrical conductor lead extending through the shaft, said terminal support being insulated from the shaft.

3. The apparatus of claim 2, said electrically conductive lead comprising:

a radially directed stud having threads on its radially inner end for engagement with said terminal support.

4. The apparatus of claim 1, said electrical connecting means comprising:

electrically conducting wedge means insertable in said first ring's radial opening between said electrically conductive lead and said first ring.

5. The apparatus of claim 1, wherein at least a portion of the insulation is heat resistant, said portion being between the shaft's exterior surface and the first ring and about the conductive lead at the shaft's exterior surface.

6. The apparatus of claim 1, wherein said electrical contact surface has grooves disposed thereacross for interrupting the electrical current passing thereto at least once for each revolution of the shaft.

* * * * *